US006650340B1

(12) United States Patent
Georges et al.

(10) Patent No.: US 6,650,340 B1
(45) Date of Patent: Nov. 18, 2003

(54) METHOD AND DEVICE FOR THE POLARIZING OF AN LCD SCREEN AS A FUNCTION OF THE AMBIENT LUMINOSITY

(75) Inventors: Laurent Georges, Bordeaux (FR); Frédéric De Lauzun, Saint Medard en Jalles (FR); François Lopez, Pessac (FR)

(73) Assignee: Sextant Avionique, Velizy Villacoublay (FR)

( * ) Notice: Subject to any disclaimer, the term of this patent is extended or adjusted under 35 U.S.C. 154(b) by 617 days.

(21) Appl. No.: 09/100,314

(22) Filed: Jun. 19, 1998

(30) Foreign Application Priority Data

Jun. 20, 1997 (FR) ..... 97 07712

(51) Int. Cl.[7] ..... G09G 5/10; G09G 3/36

(52) U.S. Cl. ..... 345/690; 345/89; 345/96; 345/147; 345/207; 345/102

(58) Field of Search ..... 345/89, 96, 147, 345/207, 102

(56) References Cited

U.S. PATENT DOCUMENTS 4,319,237 A 3/1982 Matsuo et al.
5,160,920 A * 11/1992 Harris ..... 345/147
5,347,293 A * 9/1994 Wiedemann et al. ..... 345/147
5,414,443 A * 5/1995 Kanatani et al. ..... 345/89
5,554,912 A * 9/1996 Thayer et al. ..... 315/157

FOREIGN PATENT DOCUMENTS

EP 0 313 331 A2 4/1989

OTHER PUBLICATIONS

Patent Abstracts of Japan, vol. 14, No. 4, (P–986), Jan. 9, 1990 and JP 01 255891 A, Oct. 12, 1989.

* cited by examiner

*Primary Examiner*—Richard Hjerpe
*Assistant Examiner*—Duc Q Dinh
(74) *Attorney, Agent, or Firm*—Oblon, Spivak, McClelland, Maier & Neustadt, P.C.

(57) ABSTRACT

To obtain improved readability of a liquid crystal display screen under varied conditions of ambient luminosity, it is possible to increase the dynamic range of variation of the polarizing voltage. However, this leads to an increase in the electrical power consumption and to contrast reversal defects. To prevent this phenomenon, it is proposed not to modify the dynamic range of variation of polarizing voltage but to shift this range towards the lower voltages when the ambient luminosity increases or towards the higher voltages when the ambient luminosity diminishes. Thus, the white level is favored under high ambient luminosity and the black level is favored under low or normal luminosity.

5 Claims, 2 Drawing Sheets

METHOD AND DEVICE FOR THE POLARIZING OF AN LCD SCREEN AS A FUNCTION OF THE AMBIENT LUMINOSITY

BACKGROUND OF THE INVENTION

The present invention relates to the electrical polarization of a liquid crystal display screen or LCD screen in order to obtain an image whose readability depends as little as possible on the ambient luminosity.

A liquid crystal cell consists of a thin layer of liquid crystal with a twisted nematic structure or helix nematic structure enclosed between two transparent sheets fitted out with polarizers and subjected to a variable electrical field. When there is no electrical field, and with an appropriate treatment of the internal walls of the plates, the molecules of a liquid crystal get organized in twisted or helical structures with an axis perpendicular to the two transparent planes. These structures have the property of making the polarization of light rotate whereas in the presence of an electrical field the molecules tend to get aligned in the electrical field and lose their capacity to make the polarization rotate. Thus, when the thickness of the liquid crystal layer between the two transparent plates is such that the polarization of light rotates by 90°, it is enough to cross the polarizers to have a screen that is transparent in the absence of an electrical field and a screen that is opaque in the presence of an electrical field. By locally bringing into play the value of the electrical field at each point of the surface of an LCD screen, it is then possible to modulate the light by transmission and generate images. This is obtained by the application, by means of amplifiers, of a polarizing voltage between transparent electrodes distributed in a matrix arrangement, facing each other on the two transparent plates of an LCD screen. This polarizing voltage changes between two levels: a low level for the transparent state and a higher level for the opaque state.

To obtain sufficient contrast with an LCD screen under variable conditions of low and high ambient luminosity, it is necessary to have a high dynamic range of polarizing voltage. There is therefore a tendency to increase the dynamic range of voltage for the polarizing of an LCD screen but then two problems arise: firstly, the increase in contrast obtained is not linear as a function of the gray levels, thus prompting defects in the image such as reversals of contrast and, secondly, there is an increase in electrical power consumption.

The present invention is aimed at improving the readability of an LCD screen polarized under varied conditions of ambient luminosity without thereby increasing, to any extent, the dynamic range of the polarizing voltage so as to limit the defects of polarization reversal and obtain savings in electrical power consumption.

SUMMARY OF THE INVENTION

An object of the invention is a method for the electrical polarization of an LCD screen as a function of the ambient luminosity, consisting of the measurement of the brightness of the ambient luminosity and of the polarizing of said screen by means of a polarizing voltage changing in a range of variation that is shifted, as a function of the ambient luminosity measured, towards voltages that are higher in terms of absolute value when the ambient luminosity diminishes or towards voltages that are lower in terms of absolute value when the ambient luminosity increases.

Through a shift of this kind in the range of variation of polarizing voltage as a function of the ambient luminosity, there is obtained, firstly, for the control of the opaque state of the screen, a voltage for the polarizing of the screen that is all the higher in terms of absolute value as the ambient luminosity is low, thus favoring the black level to the detriment of the white level or color levels under normal or low ambient luminosity and, secondly, for the control of the transparent state of the screen, a polarizing voltage that is all the lower in terms of absolute value as the ambient luminosity is high, thus favoring the white level or the color levels to the detriment of the black level under high ambient luminosity.

An object of the invention is also a device for the polarizing of an LCD screen comprising a counter-electrode on one face and electrodes distributed in a matrix arrangement on the other face, this device implementing the above-mentioned method. This device is provided with an amplifier that generates a reference polarizing voltage for the counter-electrode and amplifiers generating voltages for the polarizing of the gray levels ranging from the white level to the black level for the electrodes distributed in a matrix arrangement. It furthermore comprises a detector of ambient luminosity, a threshold comparator connected at input to the detector of ambient luminosity and differentiating between two conditions of ambient luminosity, one being a low or normal condition and the other being a high condition, and a memory with two zones that are addressed in alternation by said threshold comparator, this memory storing a distinct value for the reference polarizing voltage of the counter-electrode in each of its zones and being connected in the read mode of its zones to the input of the amplifier generating the reference polarizing voltage for the counter-electrode.

According to a preferred embodiment, the memory also stores, in its two zones, two distinct sets of polarizing voltages corresponding to two different scales of reference gray levels, and is furthermore connected, in the read mode of its two zones, to the input of the amplifiers generating the gray level polarizing voltages for the electrodes distributed in a matrix arrangement.

BRIEF DESCRIPTION OF THE DRAWINGS

Other features and advantages of the invention shall appear from the following description of an embodiment given by way of an example. This description shall be made with reference to the appended drawings, of which.

MORE DETAILED DESCRIPTION

Figure 1:
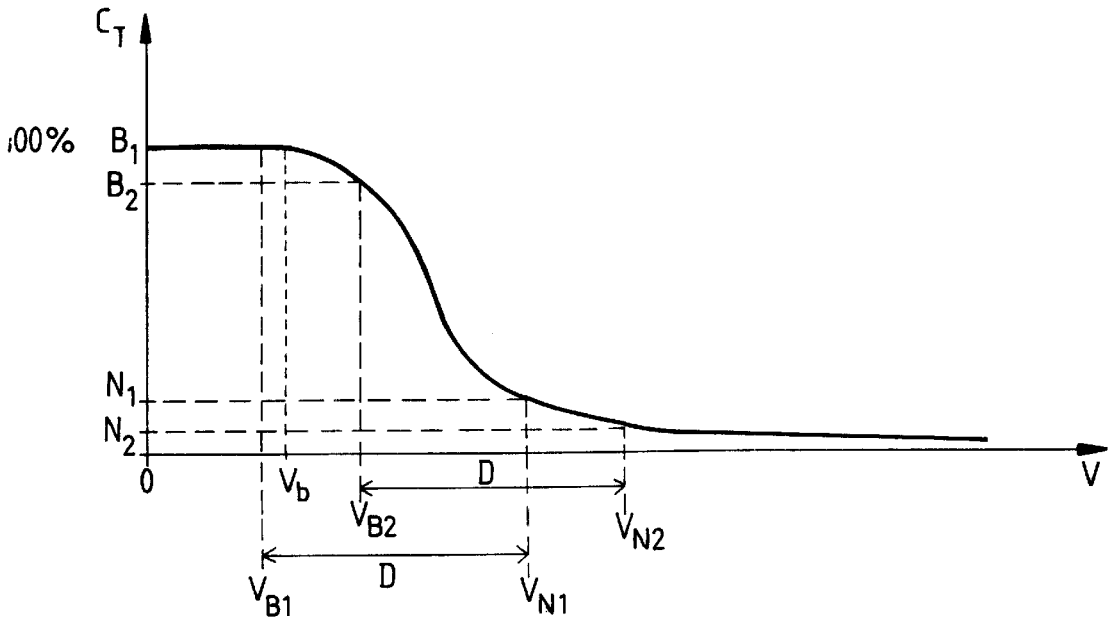
FIG. 1 is a graph explaining the progress of the coefficient of transmission of an LCD screen with crossed polarizers as a function of the polarizing voltage applied to it.

FIG. 1 shows the progress of the coefficient of transmission of a twisted nematic LCD screen with a helix angle equal to 90° and with crossed polarizers.

When there is no electrical field between the two transparent plates trapping the thin layer of liquid crystal, the liquid crystal molecules which are elongated are placed in parallel to the transparent plates and get organized, by means of an appropriate treatment of the internal walls of the transparent plates, in the form of twisted structures with an axis perpendicular to the two transparent plates which have the property of obtaining a 90° rotation of the polarization of light. The fact that the two polarizers are crossed enables the light that has crossed one of the polarizers to be retrieved with the right polarizing direction to cross the other polarizer. The LCD screen is then in its transparent state.

As soon as an electrical field is applied between the two transparent plates of the LCD screen, the helical or twisted organization of the liquid crystal molecules gets deformed, the molecules having an increasingly pronounced tendency, when the intensity of the electrical field increases, to get oriented in the direction of the electrical field. The liquid crystal gradually loses its capacity to rotate the polarization of light so that there is a constantly decreasing amount of light capable of going through the two crossed polarizers. This is expressed in FIG. 1 by a gradual drop in the value of the coefficient of transmission of the LCD screen with the increase in the polarizing voltage.

In short, from 0 volts to a switch-over voltage $V_b$, the transmission remains maximum. Beyond, there is a rapid decrease in transmission until the black levels are reached. Then the transmission continues to decrease more slowly as a function of the increase in the polarizing voltage.

This decrease in transmission as a function of the electrical field of polarization depends a great deal on the angle at which the LCD screen is seen. It decreases when the angle at which the LCD screen is seen increases, owing to the birefringence of the liquid crystal molecules. This phenomenon is accentuated when the liquid crystal molecules are oriented perpendicularly to the transparent plates, namely with high polarizing voltages that correspond to the black levels. Consequently, an LCD screen has a high degree of inhomogeneity that takes the form of defects of uniformity of the black level and contrast reversals as soon as there is a divergence from an optimum angle of view. With present-day architectures of liquid crystal cells, the cone of undisturbed observation of the image often has a butterfly-wing section, the readability being good from the viewpoints located along the diagonals of the screen and poor from the viewpoints that are laterally offset both horizontally and vertically. An observation cone of this kind is inconvenient for it does not enable a sideways observation of the screen. There are known ways of optimizing it in the horizontal direction by adding birefringent films between the polarizers and the transparent plates of the liquid crystal cell. It thus becomes possible to obtain a section that is flattened on the horizontal for the undisturbed observation cone. This corresponds to a big range of horizontal viewing angles and a small range of vertical viewing angles. The uniformity defects are then displayed with greater acuity in the vertical plane so that it becomes necessary to be concerned more particularly with the behavior of an LCD screen when the angle at which it is seen changes in the vertical plane all the more so as it is seen that the change in polarizing voltage corresponding to the black level influences the optimal angle of view in the vertical plane.

Since the dependence of the black level with respect to the angle of view in the vertical plane is smaller in a certain range favorable to observation, with high polarizing voltages there is a tendency, in order to improve the readability of an LCD screen under variable ambient luminosity, to adopt a high dynamic range for the polarizing voltage of a polarizing screen. Two problems then arise: the non-linearity of the increase in contrast as a function of the gray level which accentuates the contrast reversals and the increase in power consumption.

To resolve these problems, it is proposed to conserve a dynamic range of polarizing voltage that is limited so as to go from the white level to the black level, but to adapt it to the light environment to optimize visual comfort.

Under high luminosity, it is above all essential to have a great deal of brightness for the white level and the color levels. It is possible to downgrade the quality of the intrinsic black level when the greater part of the background luminosity comes from reflections scattered from the LCD screen. It is indeed possible to write:

$$CR = \frac{\text{White}}{\text{Black}} = \frac{B_{LCD} + \text{scattered}}{N_{LCD+scattered}} \approx \frac{B_{LCD} + \text{scattered}}{\text{scattered}}$$

where:

Cr is the coefficient of contrast, $B_{LCD}$ is the intrinsic white or maximum white level, $N_{LCD}$ is the intrinsic black or maximum black level, 'scattered' is the luminance of the screen due to scattered reflection.

A polarization $V_{B1}$ is then chosen, corresponding to the white level below the switch-over voltage $V_b$. The result thereof, if a limited dynamic range D is chosen, is a polarizing voltage $V_{N1}$ for the black level such that:

$$V_{N1}=V_{B1}+D$$

The black level obtained is downgraded but this downgrading is masked by the brightness due to the scattered reflection.

Under low luminosity, it is vitally important to have a black level that appears to be black throughout the screen and for the widest possible angles of view. Furthermore, it is not necessary to have a great deal of luminance for the white level. It is therefore chosen to give preference to the uniformity of the black level to the detriment of the transmission of the white level. For this purpose, the value of the polarizing voltage $V_{N2}$ corresponding to the black level is increased. The result thereof, owing to the limited dynamic range D adopted, is a polarizing voltage $V_{B2}$ for the white level such that:

$$V_{B2}=V_{N2}-D$$

The white level obtained is downgraded because the polarizing voltage $V_{B2}$ is greater than the switch-over voltage $V_b$ but this downgrading is of no great importance because it is above all the contrast that counts with normal or low ambient luminosity.

Figure 2:
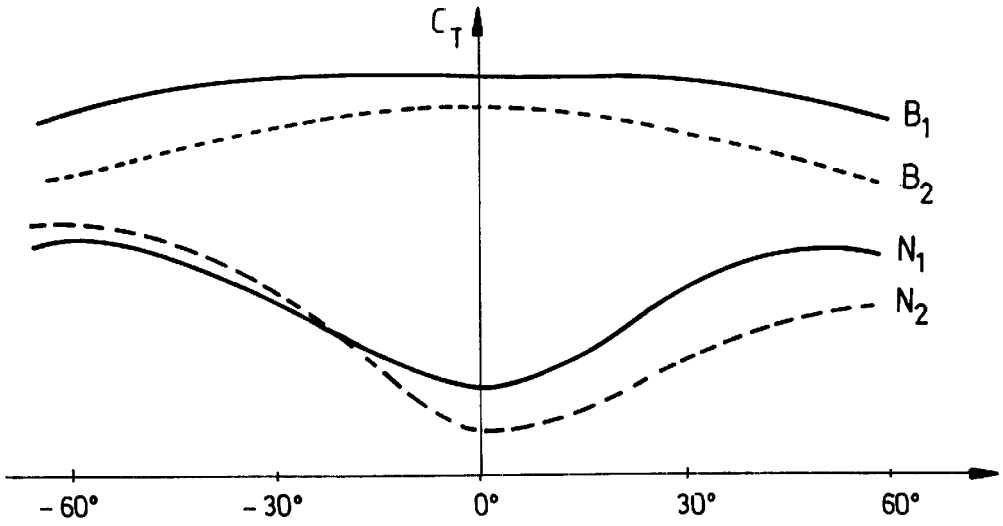
FIG. 2 is a system of curves explaining the variations of the extreme levels for the black and the white as a function of the angle at which an LCD screen is seen in the vertical plane and the shifts of the range of variations of its polarizing voltage in accordance with the method according to the invention.

FIG. 2 shows the variations of the coefficient of transmission of an LCD screen as a function of the angle of view on the vertical axis for the extreme levels of white and black corresponding to the values of polarizing voltage identified in FIG. 1.

The curves $B_1$ and $N_1$ drawn in continuous lines correspond to an ambiance of high luminosity. The curve $B_1$ represents the coefficient of transmission obtained with the polarizing voltage $V_{B1}$ adopted for the white level under high luminosity. It shows that the coefficient of transmission for the white level under high luminosity is the maximum and is relatively unaffected by a variation of the angle of view of the screen along the vertical axis. The curve $N_1$ represents the coefficient of transmission obtained with the polarizing voltage $V_{N1}$ adopted for the black level under high luminosity and deduced from the polarizing voltage $V_{B1}$ by the addition of the dynamic range D. It shows that the coefficient of transmission for the black level adopted under high luminosity is fairly affected by the variation of the angle of view and that it preserves a relatively high value when it is the minimum for an angle of view equal to 0°.

The curves $B_2$ and $N_2$ drawn in dashes correspond to an ambiance of normal or low luminosity. The curve $N_2$ represents the coefficient of transmission obtained with the polarizing voltage $V_{N2}$ adopted for the black level under normal or low luminosity. It shows that the coefficient of transmission for the black level adopted for normal or low luminosity is smaller than that adopted for high luminosity with a zero angle of view and also in a range of angles of view on the vertical axis bearing from 0 to 60° in positive values. This corresponds to an observation of the LCD screen from a position in elevation, as is the case with the LCD screen positioned on the instrument panel of a moving body, for example an aircraft cabin. The result thereof is thus a greater uniformity of the black level with respect to a high ambient luminosity on the most interesting range of angles of view. The curve $B_2$ represents the coefficient of transmission obtained with the polarizing voltage $V_{B2}$ adopted for the white level under low or normal luminosity and deduced from the polarizing voltage $V_{N2}$ by subtraction of the dynamic range D. It shows that the coefficient of transmission for the white level under low or normal luminosity is lower than the coefficient of transmission for the white level under high luminosity and is more affected by a variation of the angle of view of the screen along the vertical axis, but the deterioration remains acceptable.

Through this shifting of the dynamic range of the polarizing voltage of an LCD screen, either towards the low polarizing voltages in the event of high ambient luminosity or towards the high polarizing voltages in the event of normal or low ambient luminosity, there is a substantial improvement in readability in all circumstances without in any way thereby affecting the electrical power consumption of the screen or increasing the contrast reversal defects.

Figure 3:
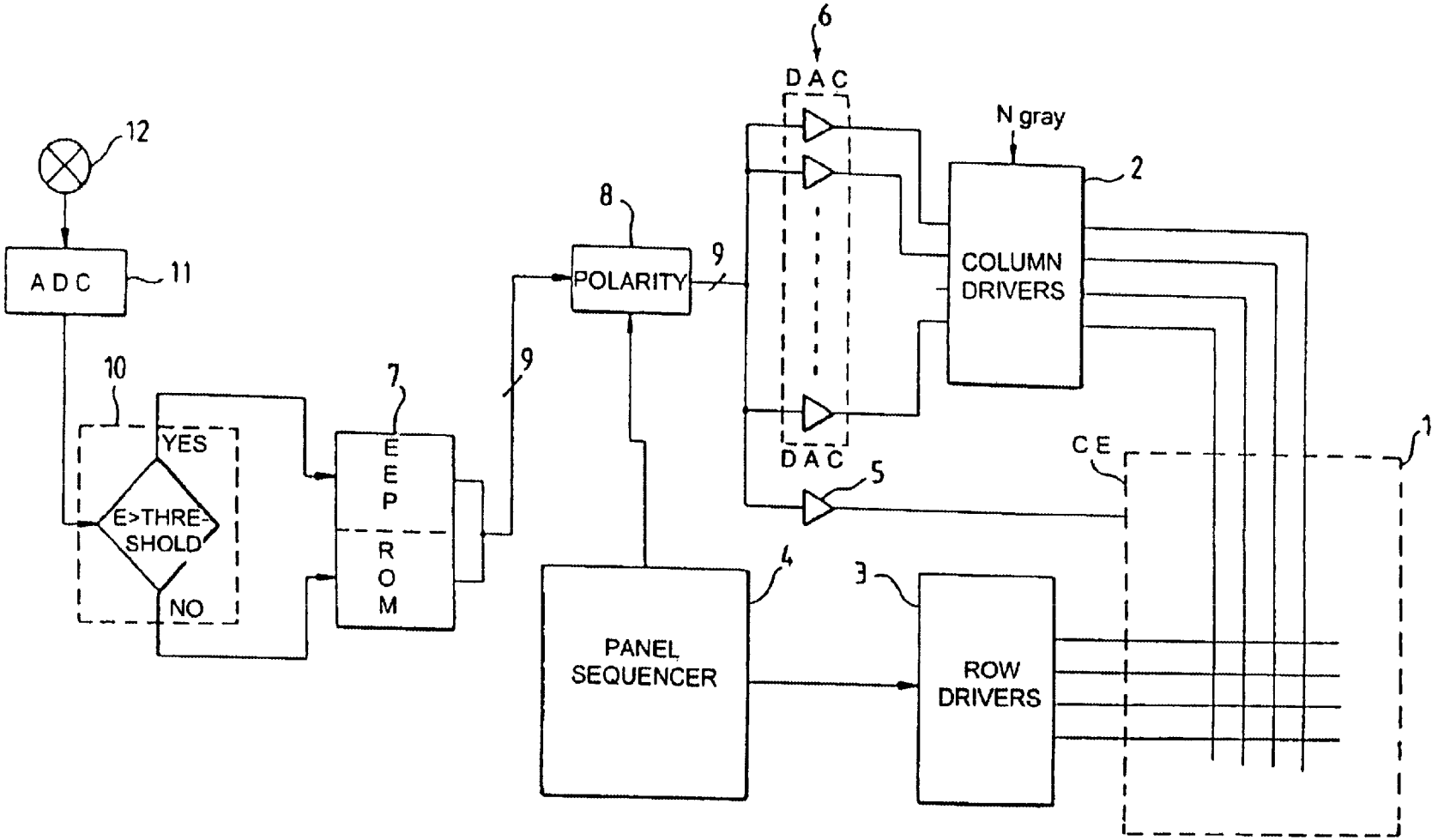
FIG. 3 is a block diagram of a device for the polarizing of an LCD screen implementing the invention.

FIG. 3 shows a device to control the polarization of an LCD screen 1 enabling the shifting of the range of variation of the polarizing voltage as a function of the ambient luminosity.

The LCD screen 1 takes the usual form of a panel with, on the rear face, a transparent counterelectrode CE and, on the front face, a set of transparent electrodes distributed in a matrix arrangement defining each pixel of the screen. The transparent electrodes distributed in a matrix arrangement are connected by switching transistors to column conductors making their way between the pixels and leading to the outputs of a bank of column amplifiers or column drivers 2 providing the gray level polarizing voltages for each column. Row conductors also make their way between the pixels and distribute the control signals to each row of switching transistors. They lead to the outputs of a bank of row amplifiers or row drivers 3. A panel sequencer 4 controls the bank of row amplifiers 3 so as to scan the panel 1 of the LCD screen row by row and provide each pixel of the LCD screen with an polarizing AC voltage as is well known in the technique of LCD screens.

The counter-electrode CE receives a reference polarizing voltage from the LCD screen 1 coming from a digital-analog converter 5.

The bank of column amplifiers 2 receives firstly reference gray levels ranging from the white to the black delivered by a bank of eight digital-analog converters 6 and, secondly, information elements $N_{gray}$ on the gray levels desired for the different pixels of the row being scanned. The bank of eight digital-analog converters 6 delivers a set of eight staged voltages which, with respect to the reference polarizing voltage of the counter-electrode CE of the LCD screen 1, define a scale of eight reference gray levels ranging from the white to the black. These staged voltages enable the positioning, at outputs of the bank 2 of the column amplifiers, of sixty-four different shades of gray, for the column amplifiers of the bank 2 are provided at input with a set of switches and summers controlled by a logic circuit as a function of the information elements $N_{gray}$ on the gray levels desired in the addressed row. The information elements $N_{gray}$ on the gray levels desired for the pixels of a row of the image are extracted from an image memory whose reading is synchronized on the panel sequencer 4.

The digital values of the data elements given to the different digital-analog converters 5, 6 are read in parallel in an EEPROM 7, their polarities being modified at will in a circuit 8 controlled by the panel sequencer 4 to periodically reverse the polarization fields and see to it that the mean voltage applied locally at each position of the LCD screen is zero so as to prevent harmful phenomena of electrolysis from reducing the lifetime of the LCD screen.

The EEPROM 7 has two storage zones for two different sets of values for the reference polarizing voltage of the counter-electrode and the voltages of the scale of the gray reference level. These two storage zones are addressed in alternation by means of a digital threshold comparator 10 receiving a measurement E of the ambient luminosity coming from an analog-digital converter 11 connected to a photodetector 12.

Through this arrangement, for the polarization of the LCD screen 1, there are two sets of values of polarizing voltages, one for the conditions of low or normal ambient luminosity and the other for the conditions of high ambient luminosity.

In all strictness, it would be enough to have only two sets of values available for the reference polarizing voltage of the counter-electrode to maintain a constant dynamic range for the zone of variation of the LCD screen polarizing voltage screen and shift this zone towards the higher voltages in terms of absolute value when the ambient luminosity diminishes or towards the lower voltages in terms of absolute value when the ambient luminosity increases. However, it is preferable also to have two sets of values for the polarizing voltages of the scale of the reference gray levels for it is then possible to correct the deformations of this scale caused by the change in value of the reference polarizing voltage of the counter-electrode.

What is claimed is:

1. A method for changing electric polarization of an LCD screen as a function of ambient luminosity, comprising:

applying a range of polarizing voltages including a minimum polarizing voltage, intermediate polarizing voltages, and a maximum polarizing voltage to vary the electrical polarization of the LCD screen;

measuring brightness of the ambient luminosity;

shifting the range of the polarizing voltages applied to said LCD screen by shifting the minimum polarizing voltage, the intermediate polarizing voltages, and the maximum polarizing voltage so that all of the polarizing voltages of the range have a shifted value as a function of whether the ambient luminosity measured in the measuring step is above or below a particular value.

2. The method according to claim 1, wherein said shifting of the range of the polarizing voltages applied to said screen shifts the minimum polarizing voltage, the intermediate polarizing voltages, and the maximum polarizing voltage by identical increments to preserve a dynamic constant.

3. A device for implementing the method according to claim 1, said device comprising:

a counter-electrode on one face of the LCD screen;

electrodes distributed in a matrix arrangement on an opposite face of the LCD screen;

reference circuitry connected to the counter-electrode and configured to couple a reference polarizing voltage received at a reference circuitry input to the counter-electrode; and grey level circuitry configured to couple grey level voltages received at grey level circuitry inputs to the electrodes distributed in the matrix arrangement to provide viewable gray scale variation ranging from a white level to a black level, wherein the reference polarizing voltage applied to the counter-electrode together with the grey level voltages applied to the electrodes distributed in the matrix arrangement provide the range of polarizing voltages being applied to the LCD screen and said device further comprises, ambient luminosity detector circuitry, a threshold comparator connected to receive an output from the ambient luminosity detector circuitry, said threshold comparator providing a first output indicating that the ambient luminosity detector circuitry is measuring the ambient luminosity as being above the particular value and a second output indicating that the ambient luminosity detector circuitry is measuring the ambient luminosity as being below the particular value, and a memory with two zones that each store a different value for the reference polarizing voltage and that are separately addressed by the first output or the second output of said threshold comparator to provide the addressed one of the different values for the reference polarizing voltage to the reference circuitry input.

4. The device according to claim 3, wherein said memory also stores in the two zones two distinct sets of values for grey level voltages corresponding to two different scales of reference gray levels, the two distinct sets of values for grey level voltages also being separately addressed by the first output or the second output of said threshold comparator to provide the addressed one of the different values for the grey level voltages to the grey level circuitry inputs.

5. The method according to claim 1, wherein the shifting of the range of the polarizing voltages is to a shifted value having a higher absolute value when the ambient luminosity is determined to be below the particular value and the range of polarizing voltages is shifted to a shifted value having a lower absolute value when the ambient luminosity is determined to be above the particular value.

* * * * *